US011842674B2

(12) United States Patent
Chang et al.

(10) Patent No.: US 11,842,674 B2
(45) Date of Patent: Dec. 12, 2023

(54) DISPLAY WITH DISCRETE GATE-IN-PANEL CIRCUITRY

(71) Applicant: GOOGLE LLC, Mountain View, CA (US)

(72) Inventors: Sun-il Chang, San Jose, CA (US); Sangmoo Choi, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/626,844

(22) PCT Filed: Nov. 8, 2019

(86) PCT No.: PCT/US2019/060497

§ 371 (c)(1),
(2) Date: Jan. 13, 2022

(87) PCT Pub. No.: WO2021/091570

PCT Pub. Date: May 14, 2021

(65) Prior Publication Data

US 2022/0262302 A1 Aug. 18, 2022

(51) Int. Cl.
*G09G 3/32* (2016.01)

(52) U.S. Cl.
CPC ..... *G09G 3/32* (2013.01); *G09G 2300/0408* (2013.01); *G09G 2300/0426* (2013.01); *G09G 2310/0286* (2013.01)

(58) Field of Classification Search
CPC ... G09G 3/32–3291; G09G 2300/0408; G09G 2300/0426; G09G 2310/0232;
(Continued)

(56) References Cited

U.S. PATENT DOCUMENTS 9,501,960 B2 * 11/2016 Park ..... G09G 3/20
10,163,383 B2 12/2018 Lee
(Continued)

FOREIGN PATENT DOCUMENTS

CN 104238214 12/2014
CN 104240658 12/2014
(Continued)

OTHER PUBLICATIONS

International Preliminary Report on Patentability in International Appln. No. PCT/US2019/060497, dated May 19, 2022, 11 pages.
(Continued)

*Primary Examiner* — Nathan Danielsen
(74) *Attorney, Agent, or Firm* — Fish & Richardson P.C.

(57) ABSTRACT

Methods, systems, and apparatus, including computer programs encoded on computer-storage media, for a display with discrete gate-in-panel circuitry. In some implementations, a display includes an array of emissive pixels arranged in rows and columns, where the array includes a first continuous area having a first pixel density and a second continuous area having a second pixel density less than the first pixel density, and consecutive rows of the emissive pixels extending between the first and second continuous areas. The display also includes gate in panel (GIP) circuits in the second continuous area, a data lines connected to the array of emissive pixels, and signal lines connected to the array of emissive pixels.

20 Claims, 5 Drawing Sheets

(58) Field of Classification Search
CPC .... G09G 2310/0243; G09G 2310/0262–0267; G09G 2310/0281; G09G 2310/0286; G09G 2310/06; G09G 2310/08; G09G 2340/0407–0421; G09G 2340/14; G09G 2340/145
See application file for complete search history.

(56) References Cited

U.S. PATENT DOCUMENTS

| | | | | |
|---|---|---|---|---|
| 2016/0012774 | A1* | 1/2016 | Ohara | G09G 3/2025 345/694 |
| 2016/0111040 | A1* | 4/2016 | Kim | G09G 3/2096 257/773 |
| 2016/0189607 | A1 | 6/2016 | Zhang | |
| 2016/0217757 | A1* | 7/2016 | Tanaka | G09G 3/3677 |
| 2017/0025070 | A1 | 1/2017 | Kang et al. | |
| 2017/0076654 | A1 | 3/2017 | Wang | |
| 2017/0115699 | A1* | 4/2017 | Park | G09G 3/20 |
| 2017/0169779 | A1* | 6/2017 | Song | G09G 3/3648 |
| 2017/0193893 | A1* | 7/2017 | Lee | G09G 3/2092 |
| 2017/0316730 | A1* | 11/2017 | Cheng | G09G 3/2092 |
| 2017/0345373 | A1 | 11/2017 | Kang et al. | |
| 2018/0033376 | A1* | 2/2018 | Fu | G09G 3/3233 |
| 2018/0068629 | A1 | 3/2018 | Shin et al. | |
| 2018/0293956 | A1 | 10/2018 | Yao et al. | |
| 2019/0027096 | A1* | 1/2019 | Kim | G09G 3/3266 |
| 2019/0164478 | A1 | 5/2019 | Kim et al. | |
| 2019/0197961 | A1* | 6/2019 | Kim | G09G 3/3266 |
| 2020/0051501 | A1* | 2/2020 | Atsuchi | G09G 3/3275 |

FOREIGN PATENT DOCUMENTS

| | | |
|---|---|---|
| JP | 2017-058671 | 3/2017 |
| JP | 2017-120401 | 7/2017 |
| KR | 10-2019-0036447 | 4/2019 |

OTHER PUBLICATIONS

International Search Report and Written Opinion in International Appln. No. PCT/US2019/060497, dated Jun. 22, 2020, 12 pages.
Office Action in European Appln. No. 19836108.1, dated May 2, 2023, 9 pages.
Office Action in Japanese Appln. No. 2022-519053, dated Apr. 25, 2023, 11 pages (with English translation).

* cited by examiner

DISPLAY WITH DISCRETE GATE-IN-PANEL CIRCUITRY

CROSS-REFERENCE TO RELATED APPLICATIONS

This application is a National Stage Application under 35 U.S.C. § 371 and claims the benefit of International Application No. PCT/US2019/060497, filed Nov. 8, 2019. The disclosure of the foregoing application is hereby incorporated by reference in its entirety.

TECHNICAL FIELD

The present specification relates to displays having emissive pixels.

BACKGROUND

Traditionally, displays include an active display area and a bezel containing processing components surrounding the active display area. The larger the bezel, the smaller the active display area and the effective size of the display is. Accordingly, the bezel limits the user experience while also decreasing the aesthetic appeal of the display and/or the device that includes the display.

SUMMARY

In some implementations, a display device includes an active display area having an array of pixels. The active display area may have multiple sections including a first active display area and a second, extended active display area. The extended active display area may contain a number of embedded pixels along with gate-in-panel (GIP) circuits. Each row of pixels in the array of pixels may contain two or more GIP circuits within the extended active display area. The GIP circuits may be placed adjacent to one or more pixels in a given row of pixels. Unlike the extended active display area, the first active display area does not contain any GIP circuits. The first active display area contains a number of embedded pixels of the array of pixels.

In some implementations, the GIP circuits for a given row of pixels in the array of pixels provide gate signals to the pixels in the row of pixels. These gate signals may include, for example, scan signals and emission control (EM) signals.

In some implementations, the first active display area has a resolution, e.g., pixel density, that is greater than the resolution of the extended active display area.

In one general aspect, a display panel includes: an array of emissive pixels arranged in a plurality of rows and a plurality of columns, where the array includes a first continuous area having a first pixel density and a second continuous area having a second pixel density less than the first pixel density, and a plurality of consecutive rows of the emissive pixels extending between the first and second continuous areas; a plurality of gate in panel (GIP) circuits provided in the second continuous area, where each row in the second continuous area includes at least two GIP circuits separated by at least one emissive pixel, and the GIP circuits in each row being configured to provide signals to the emissive pixels of the corresponding row in both the first and second continuous areas of the array; a plurality of data lines connected to the array of emissive pixels, where each of the data lines electrically connects a single pixel in each row; and a plurality of signal lines connected to the array of emissive pixels, where each of the signal lines electrically connects each of the emissive pixels and GIP circuits in a corresponding row.

Implementations may include one or more of the following features. For example, in some implementations, the second continuous area is located between an edge of the display and the first continuous area.

In some implementations, the pixel density of the second continuous area is in a range from 25% percent to 75% of the pixel density of the first continuous area.

In some implementations, the first continuous area has a width in a direction of the rows that is larger than a width of the second continuous area along the direction of the rows.

In some implementations, the display panel further includes a third continuous area between an edge of the display panel and the second continuous area, the third continuous area being free of the emissive pixels.

In some implementations, the third continuous area has a width in a direction of the rows that is smaller than a width of the second continuous area in the direction of the rows.

In some implementations, each row in the second continuous area includes alternating emissive pixels and GIP circuits.

In some implementations, the alternating emissive pixels and GIP circuits in adjacent rows are arranged in corresponding ones of the columns.

In some implementations, the alternating emissive pixels and GIP circuits in adjacent rows are offset in a checkerboard pattern.

In some implementations, the alternating emissive pixels and GIP circuits in adjacent rows are offset in a diamond pattern.

In some implementations, each pixel in a row in the second continuous area is separated by more than one GIP circuit.

In some implementations, each GIP circuit in a row in the second continuous area is separated by more than one emissive pixel.

In some implementations, each emissive pixel includes a light emitting diode (LED).

In some implementations, each LED is an organic LED (OLED).

In some implementations, the plurality of signal lines includes a plurality of scan lines and a plurality of emission control lines, where each scan line and each emission control line is associated with a corresponding row.

In some implementations, each emissive pixel includes a plurality of sub-pixels, each row has multiple corresponding emission control lines, one emission control line for each of the sub-pixels of the plurality of sub-pixels, and each of the emission control lines electrically connects a corresponding sub-pixel of each of the emissive pixels in a corresponding row.

In some implementations, each emissive pixel includes a plurality of sub-pixels, and each of the sub-pixels is connected to a signal line of the plurality of signal lines.

In some implementations, each emissive pixel includes at least one thin-film transistor (TFT), a data line of the plurality of data lines is connected to a TFT of each emissive pixel that the data line is electrically connected to, and a signal line of the plurality of signal lines is connected to a TFT of each emissive pixel that the signal line is electrically connected to.

In some implementations, each of the data lines in the first continuous area electrically connects each of the emissive pixels in a corresponding column, and each of the data lines in the second continuous area electrically connects emissive pixels in multiple columns.

In some implementations, a data line in the second continuous area electrically connects to each of the emissive pixels in every odd-numbered row of a first column and to each of the emissive pixels in every even-numbered row of a second column.

Advantageous implementations can include one or more of the following features. For example, by providing GIP circuits in the active display area instead of in a non-display area (e.g., a bezel), the size of the active display area can be increased and the size of the non-display area decreased. This extension of the active display area provides a number of benefits including, for example, smaller bezels which improves the functionality and the aesthetic appeal of a device that houses such a display, and allows for the creation of smaller devices that have the same effective display size. Specifically, these techniques may be used to reduce the size of a bezel of a display device by 50% to over 75%. Having smaller devices with the same effective display size provides its own set of benefits including, for example, requiring less material, improving ergonomics, improving aesthetic appeal, etc.

Furthermore, by placing the extended display area (e.g., lower resolution display area) between the first active display area (e.g., full resolution display area) and the bezel of the display device, the aesthetic appeal of the display device and of a device housing such a display is improved when compared to placing the extended display area at a different location since the human eye is less sensitive to non-uniformity at the edges of a display device than at, for example, the center of a display device.

The details of one or more embodiments of the invention are set forth in the accompanying drawings and the description below. Other features and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

A display includes an active display area, an extended active display area, and a thin bezel, e.g., less than or equal to 1 mm. The extended active display area includes gate-in-panel (GIP) circuitry and embedded light emitting pixels, such as light emitting diodes (LED) (e.g., micro-LEDs) or organic light emitting diodes (OLED) (e.g., micro-LEDs). Providing the GIP circuitry in the extended active display area results in the display having a reduced bezel area, an increased total active display area formed by the combination of the active display area and the extended active display area, and a lower resolution in the extended active display area compared to the active display area.

Figure 1:
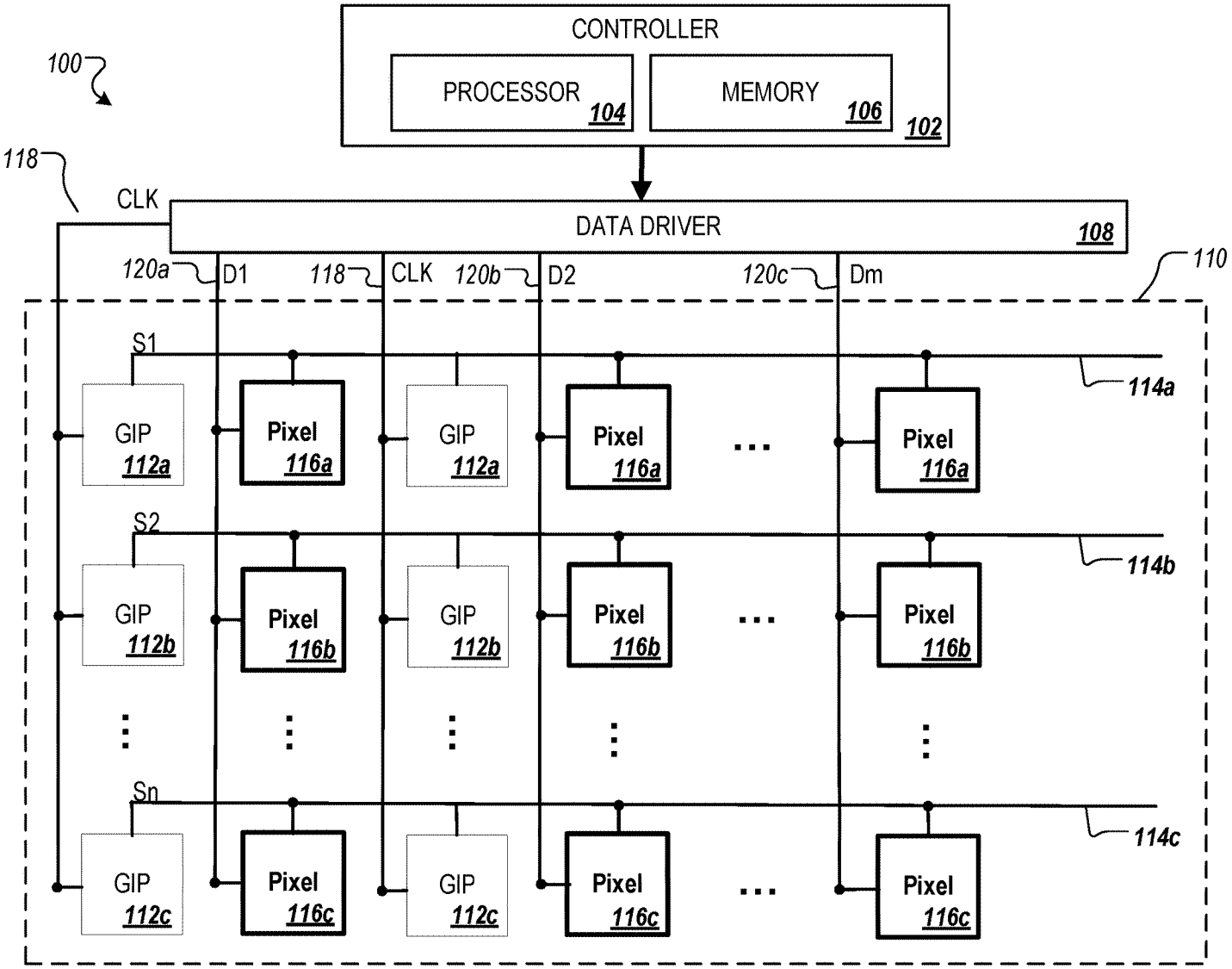
FIG. 1 is an example schematic block diagram of a display having light emitting pixels and GIP circuitry.

FIG. 1 is a schematic block diagram of an example display 100 having light emitting pixels and GIP circuitry. The display 100 includes an active display area 110, a controller 102 having a processor 104 and memory 106, a source or data driver 108, a multitude of GIP circuits 112, and a multitude of light emitting pixels 116. Additionally, the display 100 includes a power supply that is electrically connected to and provides power to the pixels 116. The pixels 116 are arranged as an array in the active display area 110, having multiple rows and columns. In a portion of the active display area 110, the GIP circuits 112 are provided in the array of the pixels 116 such that each row contains at least one GIP circuit of the GIP circuits 112.

The GIP circuits 112 supply gate signals to gate lines 114 that each of the pixels 116 are electrically connected to. Through the gate lines 114, the pixels 116 receive gate signals. The gate signals include scan and emission control (EM) signals. Accordingly, the GIP circuits 112 serve as a scan driver and an EM driver. Specifically, the GIP circuits of a particular row serve as a scan driver and an EM driver for the pixels in that row. The GIP circuits 112 may include one or more thin-film transistors (TFT).

The pixels 116 may be light emitting diodes (LED), organic light emitting diodes (OLED), micro light emitting diodes (micro-LED), or micro organic light emitting diodes (micro-OLED). Each of the pixels 116 may contain two or more sub-pixel elements. For example, each of the pixels 116 may contain one or more red micro-LEDs, one or more green micro-LEDs, and one or more blue micro-LEDs. Each of the pixels 116 may include one or more TFTs. For example, each of the pixels 116 may include one or more circuit switching TFTs and a driving TFT. Each of the pixels 116 may contain other electronic components such as one or more capacitors, e.g., a storage capacitor.

The active display area 110 of the display 100 as shown in the example of FIG. 1 may include hundreds, thousands, or millions of pixels 116. Similarly, the active display area 110 of the display 100 may include hundreds, or thousands of GIP circuits 112.

The controller 102 provides image data to the data driver 108 and may control operations of the data driver 108. The image data may include timing information such as a clock signal. Alternatively, the controller 102 may provide timing information such as a clock signal to the data driver 108. The controller 102 may include the processor 104 and the memory 106.

The data driver 108 receives image data from the controller 102. The data driver 108 may supply a clock signal to the GIP circuits 112 over the clock lines 118. The data driver 108 may supply the image data to the pixels 116 through the data lines 120.

The techniques disclosed in this document can be used to provide a display device with a greater ratio of active display area to bezel or non-display area. By providing the GIP circuitry in an extended active display area and embedding that area with light emitting pixels, the amount of active display area of the display device can be increased and the bezel area of the display can be decreased. Specifically, these techniques may be used to reduce the size of a bezel of a display device by 50% to over 75%. Increasing the active display area and/or reducing the size of the bezel area has the added benefits of improving user experience, and improving the aesthetic appeal of the display and/or of a device that includes the display.

Increasing the active display area and/or reducing the size of the bezel area also allows for reduction in device size. For example, a device having a smaller display with a greater ratio of active display area to bezel area, e.g., a device having the extended active display area, can have the same active display area of a larger device having a larger display with a lesser ratio of active display area to bezel area. Therefore, the smaller device with the improved display may be selected in place of the larger device. The benefits of a smaller device include, for example, reduced material requirements and cost, reduced weight, better ergonomics, etc.

As shown in FIG. 1, the display 100 may display image frames by controlling luminance of the pixels 116 in its active display area 110 based at least in part on received image data. To facilitate displaying an image frame, the controller 102 may provide image data to the data driver 108 and a timing controller may determine and transmit clock signals over the clock lines 118 to the GIP gate driver based at least in part on the image data. As an example, the timing controller may be included in the data driver 108. As another example, the timing controller may be included in the controller 102. In this example, the controller 102 may supply timing information as well as image data to the data driver 108. Alternatively, the timing information may be included as part of the image data.

The image data received by the data driver 108 from the controller 102 may indicate a desired luminance of one or more display pixels 116 for displaying the image frame. The data driver 108 may analyze the image data to determine a clock signal that is provided to the GIP circuits 112. Determining the clock signal may be based at least in part on what display pixels 116 the image data corresponds to. The data driver 108 may transmit the clock signal to the GIP circuits 112 over the clock lines 118. Alternatively, where the timing controller is included as part of the controller 102, the controller 102 may provide the clock signal to the GIP circuits 112 directly instead of through the data driver 108. As will be described in more detail below with respect to FIGS. 3A-3C, the clock lines generally run vertically with respect to the gate lines 114. Based at least in part on the received clock signal, the GIP circuits 112 may then transmit gate activation signals to activate a row of pixels within the pixels 116 via gate lines 114. For example, the GIP circuits 112*a* may activate a first row of pixels 116*a* through a gate line 114*a*. The GIP circuits 112*b* may activate a second row of pixels 116*b* through a gate line 114*b*. The GIP circuits 112*c* may activate a final row of pixels 116*b* through a gate line 114*c*. Each of the gate lines 114 may include a scan lines and an EM lines. For example, the gate line 114*a* may include a first scan line and a first EM line, the gate line 114*b* may include a second scan line and a second EM line, and the gate line 114*c* may include a final scan line and a final EM line of the display 100.

When activated, luminance of one or more of the pixels 116 may be adjusted by the image data received via data lines 120. In some embodiments, the data driver 108 may generate voltage data by receiving the digital image data from a controller 102. The data driver 108 may then supply the image data to the activated display pixels 116. Thus, as depicted, each display pixel of the pixels 116 may be located at an intersection of a gate line (e.g., scan line) of the gate lines 114 and a data line (e.g., source line) of the data lines 120. Based on received image data, one or more of the display pixels 116 may adjust their luminance using electrical power supplied from a power supply.

Each display pixel in the pixels 116 may include one or more circuit switching thin-film transistor (TFT), a storage capacitor, an LED which may consist of multiple sub-pixel elements, and a driving TFT. Each display pixel may also contain additional components such as one or more additional capacitors, e.g., a gate-source capacitor between the gate of the driving TFT and the LED. To facilitate adjusting luminance, the driving TFT of each of the pixels 116 and the one or more circuit switching TFTs of each of the pixels 116 may each serve as a switching device that is controllably turned on and off by voltage applied to its respective gate. As an example, a gate of a circuit switching TFT of a given pixel in the row of pixels 116*a* may be electrically coupled to the gate line 114*a*. A source of the circuit switching TFT of the pixel may be electrically coupled to one of the data lines 120, such as the data line 120*a*. Accordingly, when the circuit switching TFT of the pixel receives a gate activation signal from the gate line 114*a* that is above a threshold voltage, the circuit switching TFT may turn on, thereby activating the pixel and charging its storage capacitor with image data received at its data line 120*a*. The gate activation signals may be provided by the GIP circuits 112*a*.

Specifically, the gate activation signal may be a scan signal supplied over a scan line of the gate line 114*a*. When a scan signal is supplied to the scan line of the gate line 114*a*, one or more of the pixels in the row of pixels 116*a* in the display 100 are selected and receive data signals supplied from the data lines 120, respectively. The pixels in the row of pixels 116*a* receiving the respective data signals generate light with luminance corresponding to the data signals, thereby displaying an image (e.g., a predetermined image). Here, the emission time of each of the pixels is controlled by an EM signal supplied from an EM line of the gate line 114*a*. The EM signal supplied to the one or more pixels in the row of pixels 116*a* may be provided by the GIP circuits 112*a*. Generally, an EM signal overlaps with the scan signal supplied to one or two scan lines, and sets pixels to which data signals are supplied to be in a non-emission state.

In some embodiments, a gate of a driving TFT for a given pixel is electrically coupled to a storage capacitor. In this embodiment, voltage of the storage capacitor may control operation of the driving TFT. As an example, the driving TFT may be operated in an active region to control magnitude of supply current flowing from a power supply through the pixel's corresponding LED. As the magnitude of the gate to source voltage difference (e.g., storage capacitor voltage) increases above its threshold voltage, the driving TFT may increase the amount of its channel available to conduct electrical power, thereby increasing supply current flowing to the LED. As the magnitude of the gate to source voltage difference decreases while still being above its threshold voltage, the driving TFT may decrease the amount of its channel available to conduct electrical power, thereby decreasing supply current flowing to the LED. In this manner, the display 100 may control luminance of each of the display pixels 116 to display an image frame.

As shown, the pixels 116 are arranged as an array in the active display area 110, having multiple rows and columns. As will be described in more detail below with respect to FIG. 2, in a first portion of the active display area 110, the GIP circuits 112 are provided in the array of the pixels 116 such that each row contains at least one GIP circuit of the GIP circuits 112. The active display area 110 may include a second portion that does not contain any GIP circuits. This second portion of the active display area 110 may only include pixels and their corresponding circuitry. As mentioned above, the GIP circuits 112 supply gate signals, including, for example, scan signals and EM signals, to the pixels 116. The GIP circuits 112 may each include a TFT and may be provided in the boundaries of the active display area 110 between adjacent pixels, e.g., between pixels in the same row of pixels.

The GIP circuits 112 may receive a clock signal through the clock lines 118 from the data driver 108. The GIP circuits 112 may use the clock signal in generating the gate signals that they provide to the pixels 116. In some implementations, the clock signal may have been provided to the data driver 108 by the controller 102. In some implementations, the controller 102 may provide the clock signal directly to the GIP circuits 112 instead of through the data driver 108.

Figure 2:
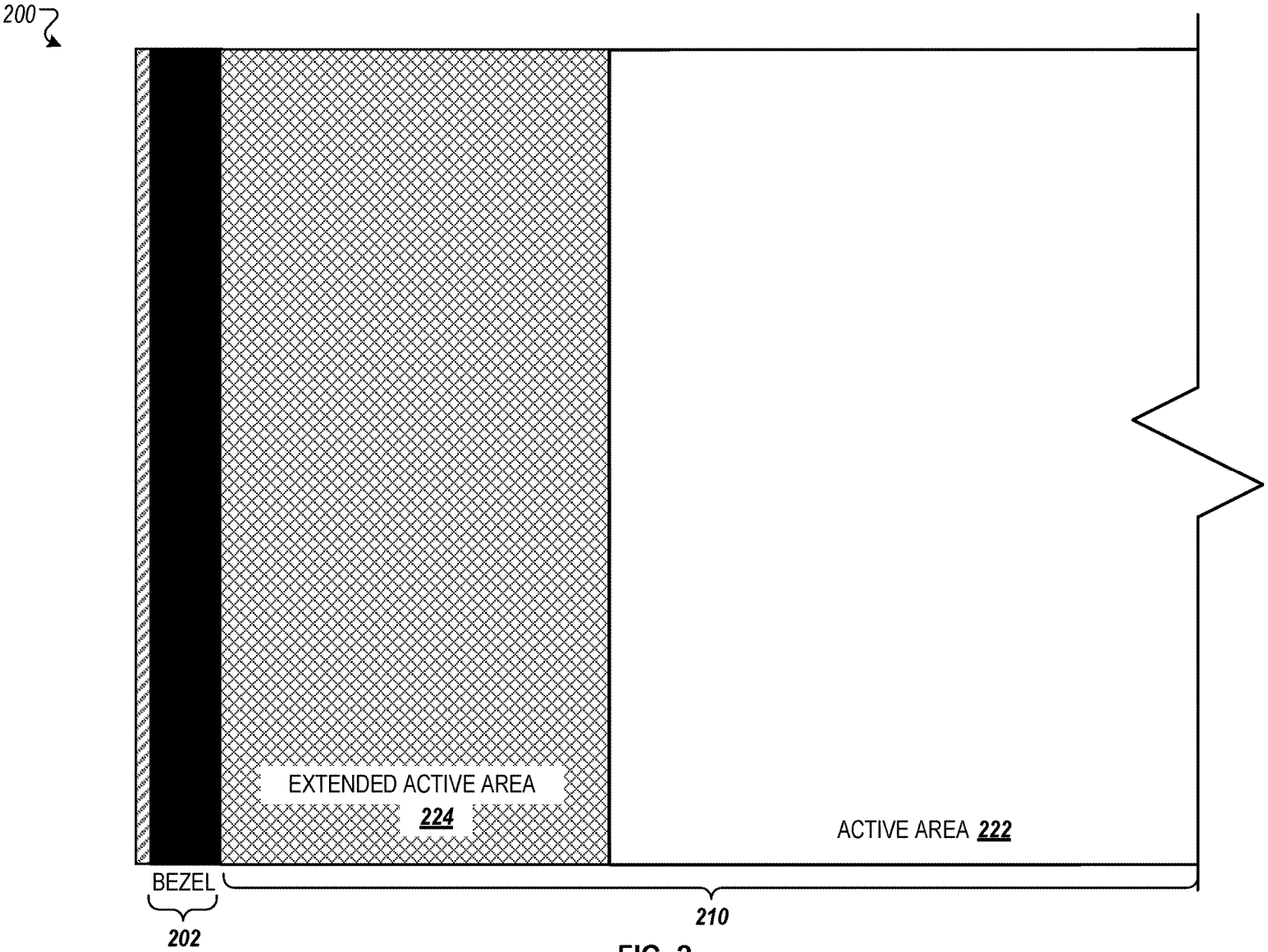
FIG. 2 is an example diagram illustrating a display having multiple active display areas.

FIG. 2 is an example diagram illustrating a display 200 having multiple active display areas. In some implementations, the display 200 is the display 100 shown in FIG. 1.

The display 200 includes a bezel region 202 that is a non-display area and an active display area 210. The bezel region 202 does not include any emissive pixels. However, the bezel region 202 may house a number of components of the display 200. For example, power supply lines or encapsulation structures can be placed in the bezel region 202.

The active display area 210 includes a first active display area 222 and an extended active display area 224. The active display area 210 may include an array of emissive pixels. In some implementations, the active display area 210 is the active display area 110 shown in FIG. 1. In some implementations, the active display area 210 is the active display area 310*a* shown in FIG. 3A. In some implementations, the active display area 210 is the active display area 310*b* shown in FIG. 3B. In some implementations, the active display area 210 is the active display area 310*c* shown in FIG. 3C.

In some implementations, the bezel region 202 has a width that less than the width of the width of the active display area. In some implementations, the bezel region 202 has a width that is less than 1 mm.

The active display area 222 corresponds with a portion of the active display area 210 having embedded pixels without discrete GIP circuits. The extended active display area 224 corresponds with a portion of the active display area 210 having embedded pixels along with discrete GIP circuits. The extended active display area 224 is located between the edge of the display 200 and the active display area 222. For example, the extended active display area 224 is located between the bezel region 202 of the display 200 and the active display area 222. The GIP circuits may be provided between adjacent pixels in the extended active display area 224. Accordingly, the active display area 222 is capable of having resolution, e.g., pixel density, greater than the resolution of the extended active display area 224 due to their being some space in the extended active display area 224 occupied by the discrete GIP circuits. That is, the active display area 222 is capable of housing a higher density of pixels than the extended active display area 224. Specifically, the resolution of the extended active display area 224 can reach 25% to 75% the maximum possible resolution of the active display area 222. Accordingly, the extended active display area 224 may have a resolution or pixel density that is 25%-75% the resolution or pixel density of the active display area 222. The resolution of the extended active display area 224 may depend on the density of GIP circuits in the extended active display area 224 and the arrangement of GIP circuits and pixels in the active display area 224.

The active display area 222 may have a width that is larger than the width of the extended active display area 224. As shown, the active display area 222 does have a width that is larger than the width of the extended active display area 224. The width of both active display areas 222 and 224 may be defined as in the direction of the rows of pixels in the array of pixels of the active display area 210 (see FIGS. 3A-3C). Similarly, the active display area 222 may have an area that is larger than the area of the extended active display area 224. Additionally, the active display area 222 may have width that is larger than the width of the bezel region 202, e.g., a width that is greater than or equal to 1 mm. Furthermore, the extended active display area 224 may have a width that is greater than the width of the bezel region 202, e.g., a width that is greater than or equal to 1 mm.

Due to the active display area 222 having a higher pixel density than the extended active display area 224 and/or due to the active display area 222 occupying a larger area than the extended active display area 224, the active display area 222 may contain the majority or the vast majority of the pixels of the display 200. A vast majority of the pixels may be defined as, for example, greater than or equal to 75% of the total pixels, greater than or equal to 80% of the total pixels, greater than or equal to 90% of the total pixels, greater than or equal to 95% of the total pixels, greater than or equal to 97% of the total pixels, greater than or equal to 99% of the total pixels, etc.

Figure 3A:
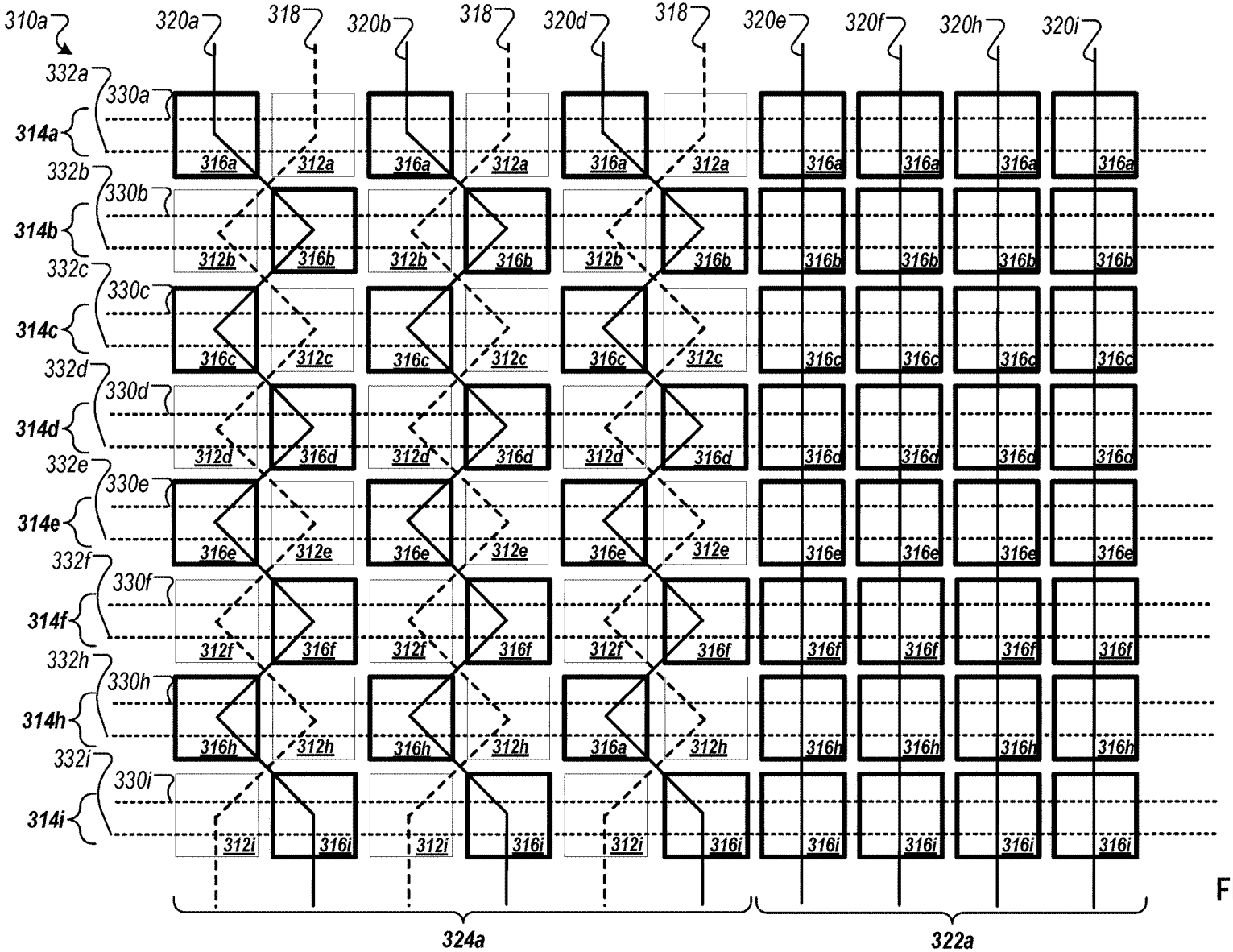
FIGS. 3A-3C are example diagrams of active display areas of displays having discrete gate-in-panel active display areas.
Figure 3B:
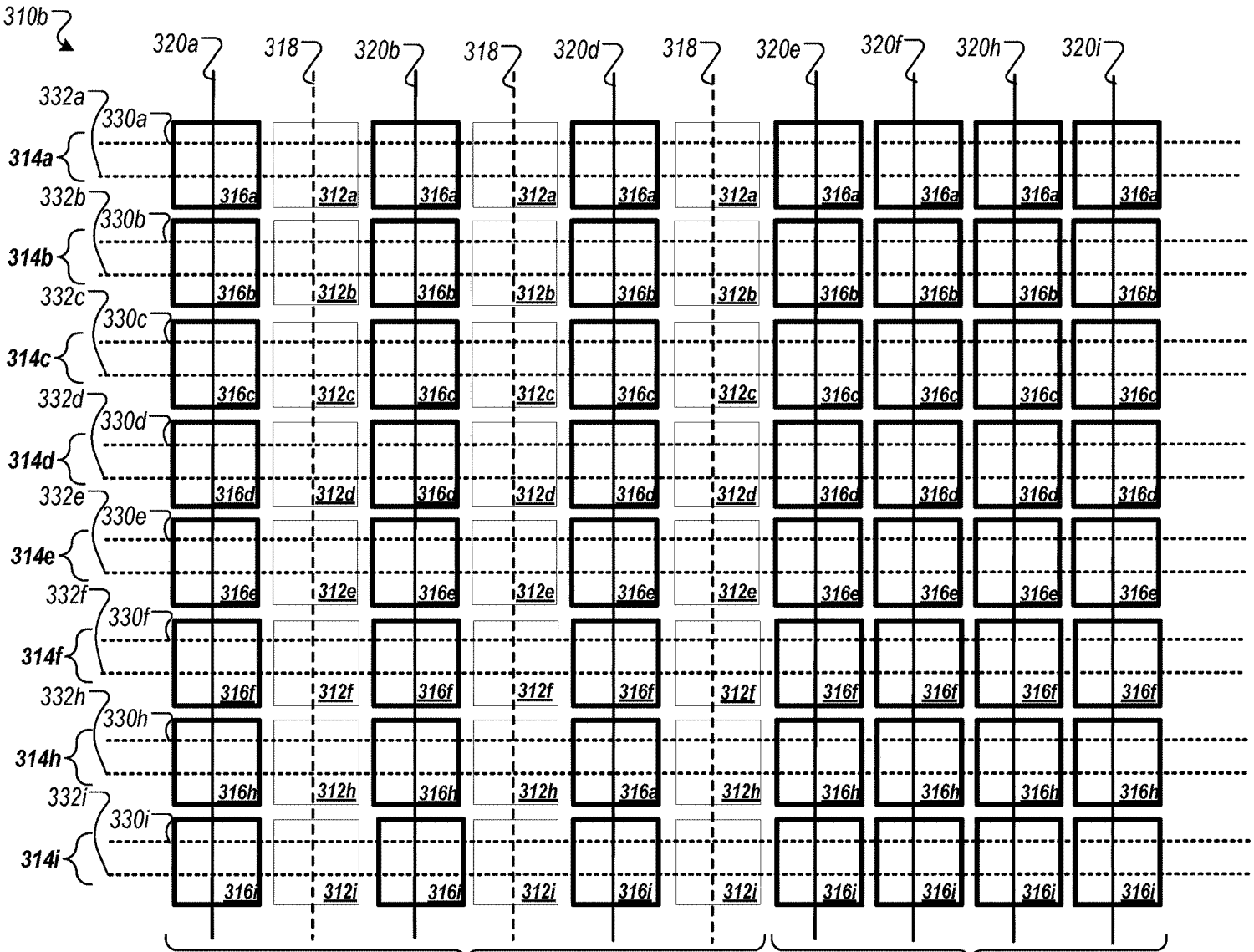
Figure 3C:
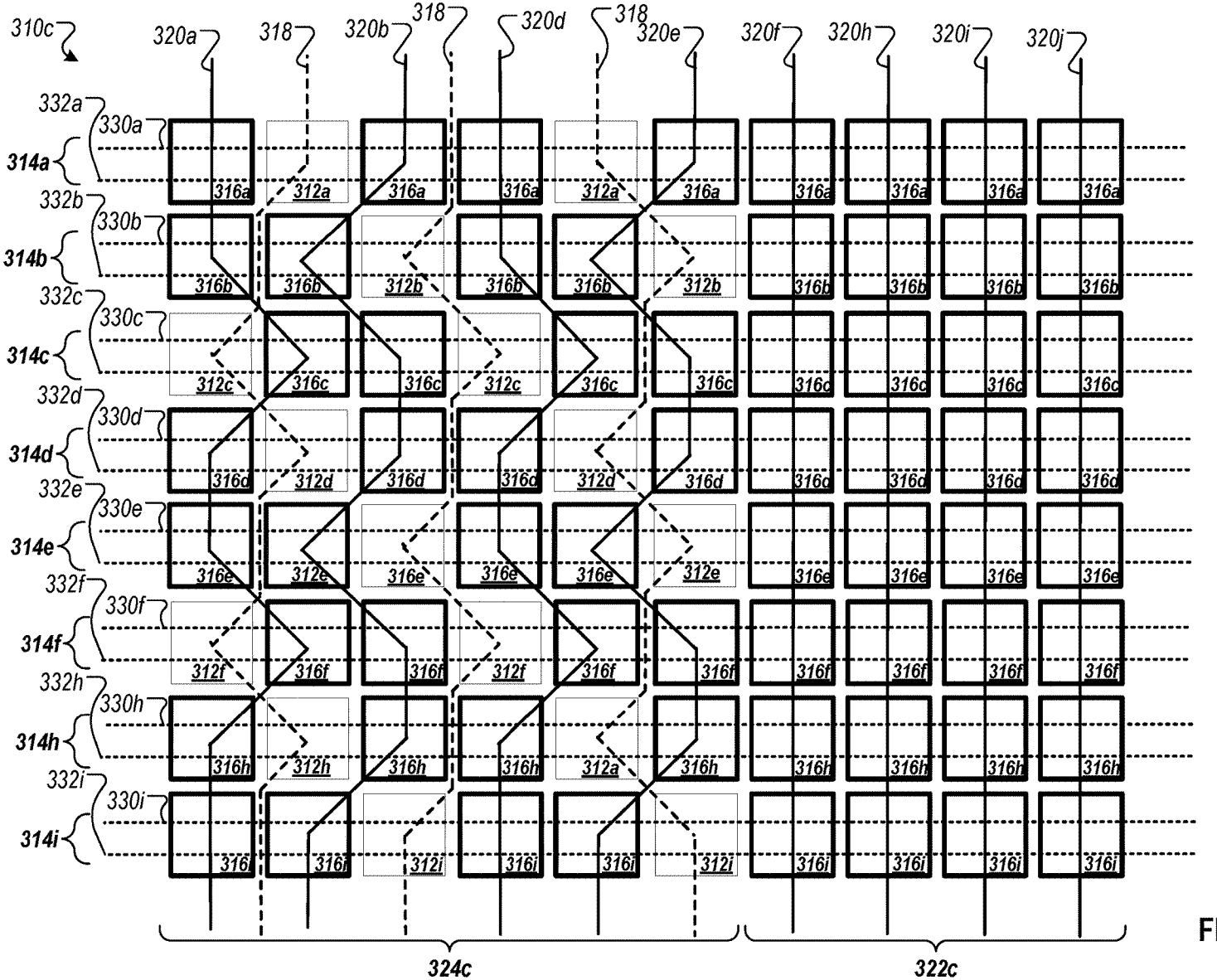

FIGS. 3A-3C are diagrams of examples of active display areas of displays having discrete gate-in-panel active display areas.

FIG. 3A shows an active display area 310*a* of a display device. The active display area 310*a* includes an array of the pixels 116. The display device may be the display 100 shown in FIG. 1. The display device may be the display 200 shown in FIG. 2. The active display area 310*a* includes an active display area 322*a* and an extended active display area 324*a*. The extended active display area 324*a* includes embedded pixels of the pixels 316 along with all of the discrete GIP circuits 312. The active display area 322*a* does not contain any of the discrete GIP circuits 312. Instead, the active display area contains only a portion of the pixels 316 and their respective circuitry.

Each row in the extended active display area 324*a* includes at least two GIP circuits (here, each row contains three GIP circuits) of the GIP circuits 312 separated by at least one emissive pixel of the pixels 316. The GIP circuits in each row are configured to provide signals to the emissive pixels of the corresponding row in both the extended active display area 324*a* and the active display area 322*a*. For example, the GIP circuits 312*b* corresponding to the pixels in the second row are configured to provide gate signals through the gate lines 314*b* to each of the pixels in the row of pixels 316*b*. Specifically, the GIP circuits 312*b* may provide scan signals through the scan line 330*b* and EM signals through the EM line 332*b* to each of the pixels in the row of pixels 316*b*.

As shown in FIG. 3A, the extended active display area 324*a* is arranged in a checkerboard pattern such that a given row of pixels and GIP circuits are offset by one with respect to a subsequent row of pixels and GIP circuits. As shown, a first row of the active display area 310*a* includes the row of pixels 316*a* and the GIP circuits 312*a*. As an example, the extended active display area 324*a* is arranged with respect to the first row such that the first row starts with a pixel, followed by a first GIP circuit, followed by a second pixel, followed by a second GIP circuit, followed by a third pixel, followed by a third GIP circuit, etc. The second row of the active display area 310*a* includes the row of pixels 316*b* and the GIP circuits 312*b*. The pixels and GIP circuits of the second row in the extended active display area 324*a* are offset by one with respect to the pixels and GIP circuits of the previous row(s) (e.g., first row) and the subsequent row(s) in the extended active display area 324*a*, thereby forming a checkerboard pattern that is continued throughout the rest of the extended active display area 324*a*. For example, the extended active display area 324*a* is arranged with respect to the second row such that the second row starts with a GIP circuit, followed by a pixel, followed by a second GIP circuit, followed by a second pixel, followed by a third GIP circuit, followed by a third pixel, etc.

In this checkerboard arrangement, each of the data lines of the data lines 320 in the active display area 322*a*, e.g., the data lines 320*e*-320*i*, electrically connects each of the emissive pixels in a corresponding column. For example, the data line 320*e* electrically connects each of the emissive pixels in the seventh column of the pixel array of the active display area 310*a*.

In this checkerboard arrangement, each of the data lines of the data lines 320 in the extended active display area 324*a*, e.g., the data lines 320*a*-320*d*, electrically connects each of the emissive pixels in multiple corresponding columns. For example, the data line 320*a* electrically connects each of the emissive pixels in the first and second columns of the pixel array of the active display area 310*a*.

Each of the pixels 316 are electrically coupled to one of the data lines 320. Although the data lines 320 are generally vertical, they may be electrically coupled to pixels in multiple columns of the pixel array of the active display area 310*a* as is the case when the extended active display area 324*a* is arranged in a checkerboard pattern as shown. The pixels 316 are also electrically coupled to gate lines 314. The gates lines 314 each contain a respective scan line of the scan lines 330 and EM line of the EM lines 332. Accordingly, each of the pixels 316 are electrically coupled to a scan line of the scan lines 330 and an EM line of the EM lines 332. For example, each of the pixels in the row of pixels 316*a* are electrically coupled to the scan line 330*a* and the EM line 332*a*.

Each of the GIP circuits 312 are electrically coupled to a clock line of the clock lines 118. The GIP circuits 312 are also electrically coupled to the gate lines 314. Accordingly, each of the GIP circuits 312 are electrically coupled to a scan line of the scan lines 330 and an EM line of the EM lines 332 through which the GIP circuits 312 is able to provide signals to the pixels 316.

FIG. 3B shows an active display area 310*b* of a display device. The active display area 310*b* includes an array of the pixels 116. The display device may be the display 100 shown in FIG. 1. The display device may be the display 200 shown in FIG. 2. The active display area 310*b* includes an active display area 322*b* and an extended active display area 324*b*. The extended active display area 324*b* includes embedded pixels of the pixels 316 along with all of the discrete GIP circuits 312. The active display area 322*b* does not contain any of the discrete GIP circuits 312. Instead, the active display area contains only a portion of the pixels 316 and their respective circuitry.

Each row in the extended active display area 324*b* includes at least two GIP circuits (here, each row contains three GIP circuits) of the GIP circuits 312 separated by at least one emissive pixel of the pixels 316. The GIP circuits in each row are configured to provide signals to the emissive pixels of the corresponding row in both the extended active display area 324*b* and the active display area 322*b*. For example, the GIP circuits 312*b* corresponding to the pixels in the second row are configured to provide gate signals through the gate lines 314*b* to each of the pixels in the row of pixels 316*b*. Specifically, the GIP circuits 312*b* may provide scan signals through the scan line 330*b* and EM signals through the EM line 332*b* to each of the pixels in the row of pixels 316*b*.

As shown in FIG. 3B, the extended active display area 324*b* is arranged in a stripe pattern such that a given column in the extended active display area 324*b* contains either pixels or GIP circuits but not both. As shown, a first row of the active display area 310*a* includes the row of pixels 316*a* and the GIP circuits 312*a*. As an example, the extended active display area 324*b* is arranged with respect to the first row such that the first row starts with a pixel, followed by a first GIP circuit, followed by a second pixel, followed by a second GIP circuit, followed by a third pixel, followed by a third GIP circuit, etc. The second row of the active display area 310*b* includes the row of pixels 316*b* and the GIP circuits 312*b*. The pixels and GIP circuits of the second row in the extended active display area 324*b* are not offset with respect to the pixels and GIP circuits of the previous row(s) (e.g., the first row) and the subsequent row(s) in the extended active display area 324*b*, thereby forming a stripe pattern that is continued throughout the rest of the extended active display area 324*b*. For example, the extended active display area 324*b* is arranged with respect to the second row such that the second row starts with a pixel, followed by a GIP circuit, followed by a second pixel, followed by a second GIP circuit, followed by a third pixel, followed by a third GIP circuit, etc.

In this stripe arrangement, each of the data lines of the data lines 320 in the active display area 322*b*, e.g., the data lines 320*e*-320*i*, electrically connects each of the emissive pixels in a corresponding column. For example, the data line 320*e* electrically connects each of the emissive pixels in the seventh column of the pixel array (where each column features either a pixel or a GIP circuit) of the active display area 310*b*.

In this stripe arrangement, each of the data lines of the data lines 320 in the extended active display area 324*b*, e.g., the data lines 320*a*-320*d*, also electrically connects each of the emissive pixels in a corresponding column. For example, the data line 320*a* electrically connects each of the emissive pixels in the first column of the pixel array of the active display area 310*b*.

Each of the pixels 316 are electrically coupled to one of the data lines 320. In the case where the extended active display area 324*b* is arranged in a stripe pattern as shown, the data lines 320 are vertical and are electrically coupled to pixels in a single column. The pixels 316 are also electrically coupled to gate lines 314. The gates lines 314 each contain a respective scan line of the scan lines 330 and EM line of the EM lines 332. Accordingly, each of the pixels 316 are electrically coupled to a scan line of the scan lines 330 and an EM line of the EM lines 332. For example, each of the pixels in the row of pixels 316*a* are electrically coupled to the scan line 330*a* and the EM line 332*a*.

Each of the GIP circuits 312 are electrically coupled to a clock line of the clock lines 118. The GIP circuits 312 are also electrically coupled to the gate lines 314. Accordingly, each of the GIP circuits 312 are electrically coupled to a scan line of the scan lines 330 and an EM line of the EM lines 332 through which the GIP circuits 312 is able to provide signals to the pixels 316.

FIG. 3C shows an active display area 310*c* of a display device. The active display area 310*c* includes an array of the pixels 116. The display device may be the display 100 shown in FIG. 1. The display device may be the display 200 shown in FIG. 2. The active display area 310*c* includes an active display area 322*c* and an extended active display area 324*c*. The extended active display area 324*c* includes embedded pixels of the pixels 316 along with all of the discrete GIP circuits 312. The active display area 322*c* does not contain any of the discrete GIP circuits 312. Instead, the active display area contains only a portion of the pixels 316 and their respective circuitry.

Each row in the extended active display area 324*c* includes at least two GIP circuits of the GIP circuits 312 separated by at least one emissive pixel of the pixels 316. The GIP circuits in each row are configured to provide signals to the emissive pixels of the corresponding row in both the extended active display area 324*c* and the active display area 322*c*. For example, the GIP circuits 312*b* corresponding to the pixels in the second row are configured to provide gate signals through the gate lines 314*b* to each of the pixels in the row of pixels 316*b*. Specifically, the GIP circuits 312*b* may provide scan signals through the scan line 330*b* and EM signals through the EM line 332*b* to each of the pixels in the row of pixels 316*b*.

As shown in FIG. 3C, the extended active display area 324*c* is arranged in a diamond pattern such that, in the extended active display area 324*c*, one or more pixels of a given row overlap one or more pixels of a subsequent row and one or more GIP circuits of a given row over lap one or more pixels of a subsequent row. As shown, a first row of the active display area 310*a* includes the row of pixels 316*a* and the GIP circuits 312*a*. As an example, the extended active display area 324*c* is arranged with respect to the first row such that the first row starts with a pixel, followed by a first GIP circuit, followed by a second pixel, followed by a third pixel, followed by a second GIP circuit, followed by a fourth pixel, etc. The second row of the active display area 310*c* includes the row of pixels 316*b* and the GIP circuits 312*b*. The pixels and GIP circuits of the second row in the extended active display area 324*c* follow the arrangement described above with respect to the pixels and GIP circuits of the previous row(s) (e.g., the first row) and the subsequent row(s) in the extended active display area 324*c*, thereby forming a diamond pattern that is continued throughout the rest of the extended active display area 324*c*. For example, the extended active display area 324*c* is arranged with respect to the second row such that the second row starts with a pixel, followed by a second pixel, followed by a GIP circuit, followed by a third pixel, followed by a fourth pixel, followed by a second GIP circuit, etc.

In this diamond arrangement, each of the data lines of the data lines 320 in the active display area 322*c*, e.g., the data lines 320*f*-320*j*, electrically connects each of the emissive pixels in a corresponding column. For example, the data line 320*f* electrically connects each of the emissive pixels in the seventh column of the pixel array of the active display area 310*c*.

In this diamond arrangement, each of the data lines of the data lines 320 in the extended active display area 324*c*, e.g., the data lines 320*a*-320*e*, electrically connects at least some of the emissive pixels in multiple corresponding columns. For example, the data line 320*a* electrically connects each of the emissive pixels in the first column of the pixel array of the active display area 310*c* and electrically connects some of the emissive pixels in the second column of the pixel array of the active display area 310*c*.

Each of the pixels 316 are electrically coupled to one of the data lines 320. Although the data lines 320 are generally vertical, they may be electrically coupled to pixels in multiple columns of the pixel array of the active display area 310*c* as is the case when the extended active display area 324*c* is arranged in a diamond pattern as shown. The pixels 316 are also electrically coupled to gate lines 314. The gates lines 314 each contain a respective scan line of the scan lines 330 and EM line of the EM lines 332. Accordingly, each of the pixels 316 are electrically coupled to a scan line of the scan lines 330 and an EM line of the EM lines 332. For example, each of the pixels in the row of pixels 316*a* are electrically coupled to the scan line 330*a* and the EM line 332*a*.

Each of the GIP circuits 312 are electrically coupled to a clock line of the clock lines 118. The GIP circuits 312 are also electrically coupled to the gate lines 314. Accordingly, each of the GIP circuits 312 are electrically coupled to a scan line of the scan lines 330 and an EM line of the EM lines 332 through which the GIP circuits 312 is able to provide signals to the pixels 316.

In some implementations, each of the pixels 316 shown in FIGS. 3A-3C includes multiple sub-pixels element. In these implementations, each of the gate lines 114 for a given row may include multiple EM lines. Each of the multiple EM lines may be capable of transmitting individual EM signals to a particular sub-pixel element of each pixel in a row of pixels of the array of pixels. For example, the gate lines 114*a* may include three EM lines corresponding to the first row of pixels 116*a*. The first EM line of the first row may be electrically coupled to and/or capable of transferring EM signals to a red sub-pixel element of each of the pixels in the row of pixels 116*a*. The second EM line of the first row may be electrically coupled to and/or capable of transmitting EM signals to a green sub-pixel element of each of the pixels in the row of pixels 116*a*. The third EM line of the first row may be electrically coupled to and/or capable of transferring EM signals to a blue sub-pixel element of each of the pixels in the row of pixels 116*a*.

A number of implementations have been described. Nevertheless, it will be understood that various modifications may be made without departing from the spirit and scope of the disclosure. For example, various forms of the flows shown above may be used, with steps re-ordered, added, or removed.

Embodiments of the invention and all of the functional operations described in this specification can be implemented in digital electronic circuitry, or in computer software, firmware, or hardware, including the structures disclosed in this specification and their structural equivalents, or in combinations of one or more of them. Embodiments of the invention can be implemented as one or more computer program products, e.g., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a tablet computer, a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the invention can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the invention, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

In each instance where an HTML file is mentioned, other file types or formats may be substituted. For instance, an HTML file may be replaced by an XML, JSON, plain text, or other types of files. Moreover, where a table or hash table is mentioned, other data structures (such as spreadsheets, relational databases, or structured files) may be used.

Particular embodiments of the invention have been described. Other embodiments are within the scope of the following claims. For example, the steps recited in the claims can be performed in a different order and still achieve desirable results.

What is claimed is:

1. A display panel comprising:

an array of emissive pixels arranged in a plurality of rows and a plurality of columns, wherein the array comprises a first continuous area having a first pixel density and a second continuous area having a second pixel density less than the first pixel density, and a plurality of consecutive rows of the emissive pixels extending between the first and second continuous areas;

a plurality of gate in panel (GIP) circuits provided in the second continuous area, wherein each row in the second continuous area comprises at least two GIP circuits separated by at least one emissive pixel, and the GIP circuits in each row being configured to provide signals to the emissive pixels of the corresponding row in both the first and second continuous areas of the array;

a plurality of data lines connected to the array of emissive pixels, wherein each of the data lines electrically connects a single pixel in each row; and a plurality of signal lines connected to the array of emissive pixels, wherein each of the signal lines electrically connects each of the emissive pixels and GIP circuits in a corresponding row.

2. The display panel of claim 1, wherein the second continuous area is located between an edge of the display and the first continuous area.

3. The display panel of claim 1, wherein the pixel density of the second continuous area is in a range from 25% percent to 75% of the pixel density of the first continuous area.

4. The display panel of claim 1, wherein the first continuous area has a width in a direction of the rows that is larger than a width of the second continuous area along the direction of the rows.

5. The display panel of claim 1, further comprising a third continuous area between an edge of the display panel and the second continuous area, the third continuous area being free of the emissive pixels.

6. The display panel of claim 5, wherein the third continuous area has a width in a direction of the rows that is smaller than a width of the second continuous area in the direction of the rows.

7. The display panel of claim 1, wherein each row in the second continuous area comprises alternating emissive pixels and GIP circuits.

8. The display panel of claim 7, wherein the alternating emissive pixels and GIP circuits in adjacent rows are arranged in corresponding ones of the columns.

9. The display panel of claim 7, wherein the alternating emissive pixels and GIP circuits in adjacent rows are offset in a checkerboard pattern.

10. The display panel of claim 7, wherein the alternating emissive pixels and GIP circuits in adjacent rows are offset in a diamond pattern.

11. The display panel of claim 1, wherein each pixel in a row in the second continuous area is separated by more than one GIP circuit.

12. The display panel of claim 1, wherein each GIP circuit in a row in the second continuous area is separated by more than one emissive pixel.

13. The display panel of claim 1, wherein each emissive pixel comprises a light emitting diode (LED).

14. The display panel of claim 13, wherein each LED is an organic LED (OLEO).

15. The display panel of claim 1, wherein the plurality of signal lines comprises a plurality of scan lines and a plurality of emission control lines, wherein each scan line and each emission control line is associated with a corresponding row.

16. The display panel of claim 15, wherein:

each emissive pixel comprises a plurality of sub-pixels, each row has multiple corresponding emission control lines, one emission control line for each of the sub-pixels of the plurality of sub-pixels, and each of the emission control lines electrically connects a corresponding sub-pixel of each of the emissive pixels in a corresponding row.

17. The display panel of claim 1, wherein:

each emissive pixel comprises a plurality of sub-pixels, and each of the sub-pixels is connected to a signal line of the plurality of signal lines.

18. The display panel of claim 1, wherein:

each emissive pixel comprises at least one thin-film transistor (TFT), a data line of the plurality of data lines is connected to a TFT of each emissive pixel that the data line is electrically connected to, and a signal line of the plurality of signal lines is connected to a TFT of each emissive pixel that the signal line is electrically connected to.

19. The display panel of claim 1, wherein:

each of the data lines in the first continuous area electrically connects each of the emissive pixels in a corresponding column, and each of the data lines in the second continuous area electrically connects emissive pixels in multiple columns.

20. The display panel of claim 1, wherein a data line in the second continuous area electrically connects to each of the emissive pixels in every odd-numbered row of a first column and to each of the emissive pixels in every even-numbered row of a second column.

* * * * *